United States Patent [19]

Yokota et al.

[11] 4,342,818

[45] Aug. 3, 1982

[54] PROCESS FOR FORMING COLOR FILTER

[75] Inventors: Yukio Yokota, Minami-ashigara; Masamichi Sato; Kenji Matsumoto, both of Asaki, all of Japan

[73] Assignee: Fuji Photo Film Co., Ltd., Kanagawa, Japan

[21] Appl. No.: 218,972

[22] Filed: Dec. 22, 1980

[30] Foreign Application Priority Data

Dec. 25, 1979 [JP] Japan ..... 54/168564

[51] Int. Cl.[3] ..... G03C 7/00

[52] U.S. Cl. ..... 430/7; 430/243; 430/365; 430/366; 430/390; 430/391

[58] Field of Search ..... 430/4, 7, 17, 29, 243, 430/224, 225, 364, 365, 366, 390, 391

[56] References Cited

U.S. PATENT DOCUMENTS

| | | | |
|---|---|---|---|
| 2,146,040 | 2/1939 | Wilmanns et al. | 430/224 |
| 2,543,691 | 2/1951 | Friedman | 430/225 |
| 2,983,606 | 5/1961 | Rogers | 430/224 |
| 3,255,001 | 6/1966 | Blout et al. | 430/224 |
| 4,271,246 | 6/1981 | Sato et al. | 430/366 |

OTHER PUBLICATIONS

Research Disclosure, No. 17369, Sep. 1978.

*Primary Examiner*—J. Travis Brown

*Attorney, Agent, or Firm*—Sughrue, Mion, Zinn, Macpeak & Seas

[57] ABSTRACT

A process for forming a color filter, which comprises patternwise exposing a black-and-white silver halide emulsion layer of a photographic material comprising a support having thereon at least one black-and-white silver halide emulsion layer, developing the photographic material with a developing solution containing a color dye developer to form a pattern containing a color dye for a pattern containing at least one dye, and removing remaining silver and/or silver halide. The patternwise exposure and color coupler containing development steps can be repeated using different color couplers to produce patterns with additional color dyes.

6 Claims, 4 Drawing Figures

PROCESS FOR FORMING COLOR FILTER

BACKGROUND OF THE INVENTION

This invention relates to an improvement in a process for forming a color filter according to a silver salt photographic process.

A process for forming a color filter using a coupler-in-developer type color developing process is described in Japanese Patent Application No. 78313/78 (corresponding to U.S. patent application Ser. No. 52,704, filed June 28, 1979, now U.S. Pat. No. 4,271,246) by some of the same inventors herein. This color filter-forming process fundamentally comprises subjecting to a first patternwise exposure a black-and-white silver halide emulsion layer of a photographic material comprising a support having thereon at least one black-and-white emulsion layer, developing the photographic material with a coupler-in-developer color-developing process wherein the color developer contains a color coupler to form a pattern containing the first color dye and, after final color development, conducting a silver-removing processing. Further, after formation of the first color pattern, similar steps are repeated to form another pattern containing a second color dye, and so on, thus forming at least two color patterns.

This process provides the advantage that a color filter can be obtained much less expensively as compared to known color filters using an interference filter or those obtained by dyeing a relief of a high molecular weight polymer material with a dye.

However, color filters obtained by this process described in Japanese Patent Application No. 78313/78 have the defect that they have spectral characteristics which are not as sharp as those of known interference filters or the like. That is, as is shown in FIG. 1, when transmittance is plotted as the ordinate and wavelength as the abscissa, the change in transmittance of, for example, a yellow filter over the transmittance range of from about 0% to about 90% is not as sharp as indicated by curve A.

SUMMARY OF THE INVENTION

As a result of intensive investigations to remove the above-described defect while maintaining the above-described advantages of the former application, the inventors have discovered that a color filter with sharp spectral characteristics can be obtained by patternwise exposing a photographic material comprising a support having thereon at least one black-and-white silver halide emulsion layer, and developing the photographic material in a developing solution containing a dye developer.

Dye developers are known and are usually used in an instant photographic process. However, such instant photographic process utilizes the phenomenon that, when exposed silver halide is developed, the dye developer is oxidized and becomes non-diffusible, whereas unreacted dye developer in the unexposed portions becomes diffusible on development due to its alkali-soluble properties and is transferred to an image-receiving layer, thus forming an image of dye molecules diffused from the unexposed portions (diffusion transfer process). Therefore, a dye developer is used to obtain positive images. On the contrary, in the present invention the diffusion transfer process is not employed, but a pattern composed of dye and silver formed in the imagewise exposed portions of a silver halide emulsion layer, i.e., negative image dye, is used to form images. Thus, the two processes are absolutely different from each other. And, according to the present invention, a novel effect of providing a color filter with sharp spectral characteristics as shown in FIG. 1, curve B, is produced through simple steps. In addition, another novel effect of providing a color filter having excellent fading resistance and heat resistance is produced. Further, considering the fact that coupler-in-developer type color developers require a coupling reaction and therefore dyes to be used are limited only to those which readily undergo such a coupling reaction, dye developers provide the effect of permitting dyes with good spectral characteristics to be freely selected and the selection of dyes with good fading resistance and heat resistance is facilitated. The fading resistance and heat resistance as well as the above-described spectral characteristics are extremely important in applying the resulting color filter, for example, to a camera tube. In the case of, for example, applying the color filter to a planar plate for a camera tube or further forming thereon a photosensitive layer, the color filter of the present invention can be heated. Still further, deterioration of the color filter can be avoided even when it is used for a long time for a camera tube.

Therefore an object of the present invention is to provide a process for inexpensively forming a color filter suitable for use in, for example, a color camera tube or solid state camera devices.

Another object of the present invention is to provide a color filter having sharp spectral characteristics.

These objects are attained by a process for forming a color filter, which comprises subjecting to a first patternwise exposure a black-and-white silver halide emulsion layer of a photographic material comprising a support having thereon at least one black-and-white silver halide emulsion layer, developing the photographic material with a developing solution containing a first color dye developer and, if necessary, conducting again the patternwise exposure and development with a different color dye developer to form a second color pattern and so on thus forming a pattern containing at least one dye, and removing remaining silver and/or silver halide as a final step.

Figure 1:
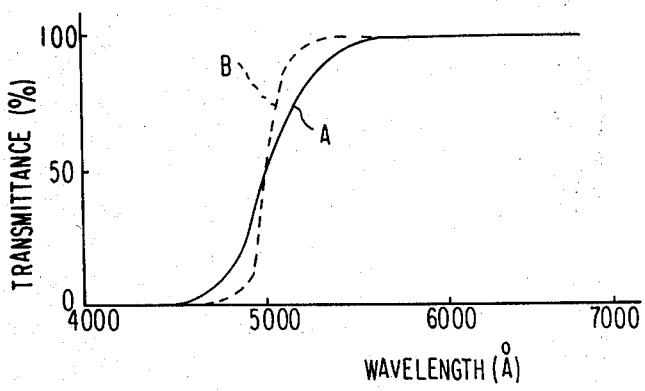
FIG. 1 is a graph showing the spectral characteristics of a color filter obtained utilizing a silver salt photographic process.

In these drawings, reference numeral 20 designates a support, 21 a silver halide emulsion layer, and 30 and 40 photomasks.

DETAILED DESCRIPTION OF THE INVENTION

The present invention will be described in more detail by reference to the accompanying drawings.

Figure 2:
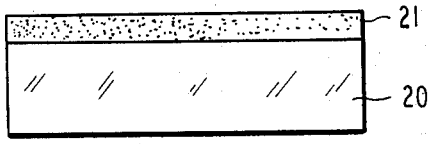
FIGS. 2 and 4 are cross-sectional views showing the steps of forming color filters of the present invention.

FIG. 2 shows one embodiment of a photographic material to be used in the present invention, wherein a fine-grain black-and-white silver halide emulsion layer 21 is provided on a support 20. A subbing layer may be provided if necessary on the support.

Where support 20 itself forms a support of an optical filter, the support must be transparent to visible light but, in the case of initially forming a color filter layer on the support and then transferring it onto another transparent support, a semi-transparent or opaque support may be used as well as a transparent support, because it is used only as a temporary support. And, as to shape of the support, the support may have a plate shape, a sheet shape, or a film shape. Suitable materials for the support which can be used, for example, include synthetic resins such as polyethylene terephthalate, polystyrene, polycarbonate, cellulose acetate, etc., glass, quartz, sapphire, and the like. The support itself may have other functions; for example, it may also function as a planar plate of a camera tube.

The subbing layer to be provided, if desired, in the present invention is a layer of a material that strongly adheres to both support 20 and silver halide emulsion layer 21. Suitable materials which can be used for the subbing layer are gelatin, albumin, casein, cellulose derivatives, starch derivatives, sodium alginate, polyvinyl alcohol, polyvinyl pyrrolidone, polyacrylic acid copolymer, polyacrylamide, etc. The thickness of the subbing layer is desirably as thin as possible, i.e., about 0.01 to 1 μm, preferably 0.05 to 0.5 μm.

Suitable silver halide emulsions which can be coated on the support directly or via the subbing layer are known emulsions obtained by dispersing silver halide in a water-soluble binder. In the present invention, fine-grain emulsions are particularly preferable; for example, a so-called Lippmann emulsion having a mean silver halide grain size of about 0.1 μm or less is preferred. The weight ratio of silver halide to water-soluble binder is within the range of from about 1:6 to 8:1. Exemplary silver halides which can be used are silver chloride, silver bromide, silver iodide, silver chlorobromide, silver bromoiodide, silver chloroiodide, silver chlorobromoiodide, etc. Illustrative water-soluble binders are gelatin, albumin, casein, cellulose derivatives, agar-agar, sodium alginate, sugar derivatives, polyvinyl alcohol, polyvinyl pyrrolidone, polyacrylamide, etc. If desired, a compatible mixture of two or more of these binders can be used. The dry thickness of silver halide emulsion layer 21 is preferably within the range of about 0.8 to about 10 μm.

A antihalation backing layer may be provided, if desired, on the back side of the support 20 to the thus formed photographic material.

Figure 3:
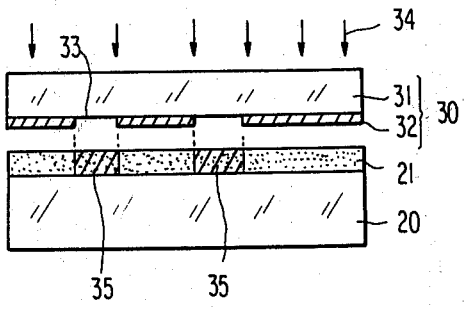

This photographic material is subjected to imagewise exposure 34 corresponding to the first color pattern of a multi-color optical filter, for example, a yellow striped or mosaic pattern, through a photomask 30 as shown in FIG. 3. Conventional photomasks can be used. For example, a chromium mask comprising a glass plate 31 having provided thereon light-intercepting portions 32 composed of chromium forming imagewise transparent pattern 33 corresponding to the first color pattern can be used. Suitable light sources to be used upon exposure can be any source that emits light of a wavelength to which the silver halide emulsion layer is sensitive. For example, a light source emitting white light can be used. The so-called contact exposure wherein uniform irradiation is conducted with the photomask superposed on the emulsion layer 21 as shown in FIG. 3 can be used. Also, a projection exposure wherein an image is exposed using a lens system can be employed.

Figure 4:
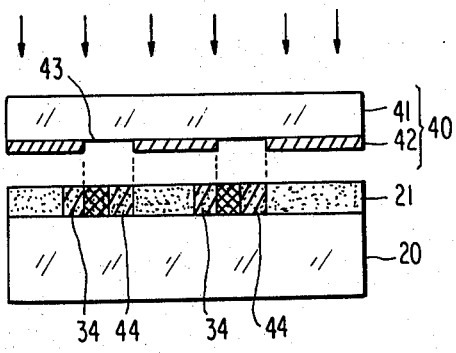

The thus exposed photographic material is then subjected to development using a first dye developer. For example, when developing the photographic material in a developing solution containing a yellow dye developer, pattern 35 composed of the yellow dye and silver grains is formed in the exposed portions. In the case of forming a mono-color filter containing the dye pattern obtained by this first development, silver in the pattern 35 is bleached away or, after re-halogenation, the remaining silver halide is removed, after completion of the first development. Thus, for example, a yellow filter is obtained. The step to be conducted after completion of the first development uses a bleach-fixing solution known in the field of color photography, which reduces the steps to only one step.

Where a second dye pattern in addition to the first dye pattern is to be formed, silver is bleached away or re-halogenated followed by washing with water, after completion of the first development, and, if desired, dried. Then, as is shown in FIG. 4, a second pattern, for example, a cyan color pattern, is imagewise exposed in the same manner as described above using a second photomask 40 across the yellow pattern 34. The photomask 40 may be the same chromium mask as described hereinbefore, which comprises a transparent support 41 having thereon a light-intercepting chromium pattern 42 and an imagewise transparent pattern 43 corresponding to the second color pattern. The thus exposed photographic material is then subjected to development using a second dye developer. For example, when this photographic material is developed in a developing solution containing a cyan dye developer, a pattern 44 composed of the cyan dye and silver is formed across the already formed yellow pattern 34. After completion of the second development, silver is removed in the same manner as described above by bleaching or re-halogenating followed by removal of the remaining silver halide. Thus, a filter wherein yellow and cyan patters cross each other is obtained.

A third dye pattern and so on may be formed, if desired, in the same manner. In the present invention, it is necessary for the silver and/or unused silver halide to be removed at least after formation of the final pattern. That is, in the case of forming a pattern of a dye alone, it is necessary in the present invention to remove silver and unused silver halide after formation of the final pattern and, in the case of forming a color filter containing silver grains in part of the pattern, it is necessary to remove unused silver halide.

The dye developer-containing developing solution which is used in the present invention is an alkaline aqueous solution (pH: about 9 or more, preferably 10.5 to 13) of an alkali-soluble dye developer capable of being oxidized by development to become insoluble and fixed in the silver image portions. To this aqueous solution are added a pH-adjusting agent or a buffering agent such as sodium hydroxide, sodium carbonate, sodium phosphate, etc.; an anti-fogging agent such as potassium bromide, etc.; an organic solvent for increasing the solubility of the dye developer (e.g., dimethylformamide, methyl ethyl ketone, etc.); and the like.

In the present invention, any conventional dye developer known in the art can be used, such as those described in, for example U.S. Pat. Nos. 2,983,605, 2,983,606, 2,992,106, 3,047,386, 3,076,808, 3,076,820, 3,077,402, 3,126,280, 3,131,061, 3,134,762, 3,134,765, 3,135,604, 3,135,605, 3,135,606, 3,135,734, 3,141,772, 3,142,565, 3,173,906, 3,183,090, 3,218,164, 3,230,082, 3,230,083, 3,230,086, 3,239,339, 3,245,790, 3,309,199, 3,246,985, 3,320,063, 3,320,083, 3,347,672, 3,347,673, 3,453,107, 3,579,334, 3,482,972, and 3,563,739; Australian Pat. No. 220,279; German Pat. No. 1,036,640; British Pat. Nos. 804,971, 804,973, 804,974, and 804,975; Belgian Pat. Nos. 554,935 and 568,344; Canadian Pat. Nos. 579,038 and 577,021; French Pat. No. 1,168,292; etc.
Suitable specific dye developers which can be incorporated in the respective developing solutions include the following:
Y-1
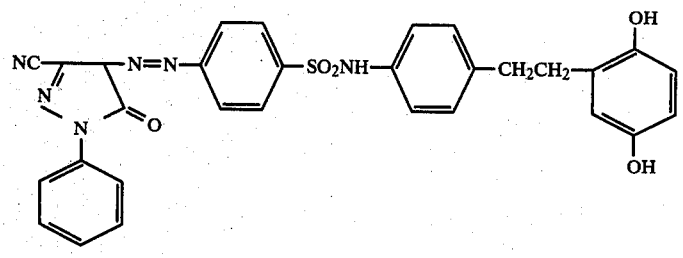
Y-2
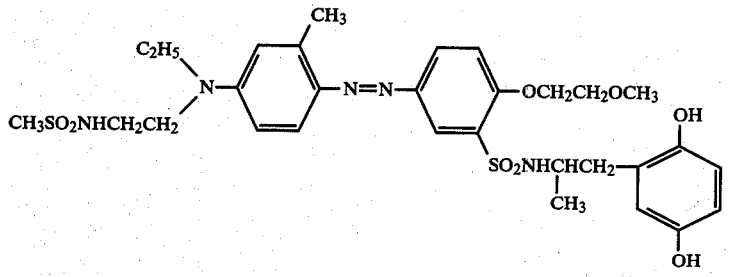
Y-3
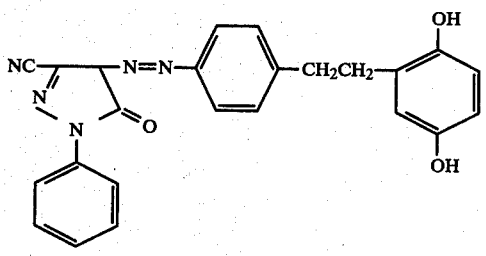
M-1
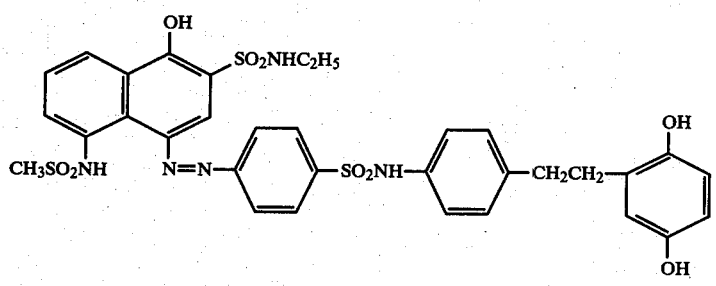
M-2
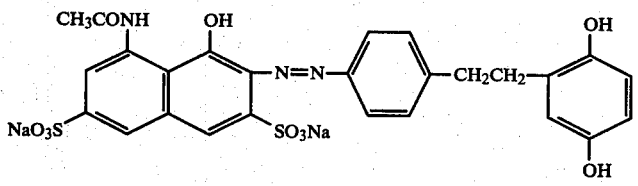
M-3
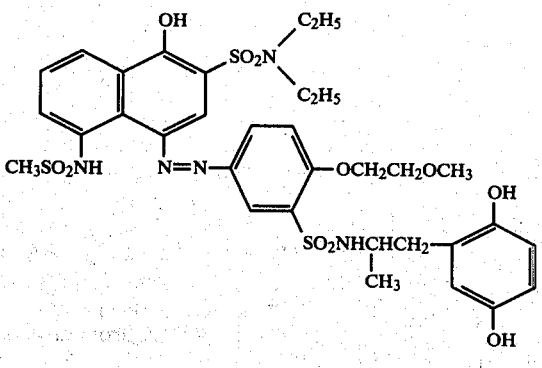

-continued

C-1

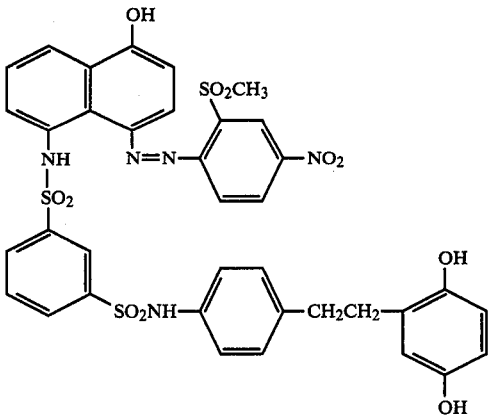

C-2

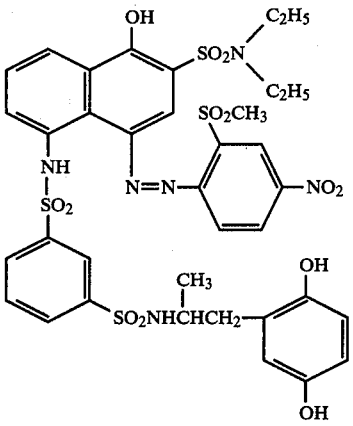

C-3

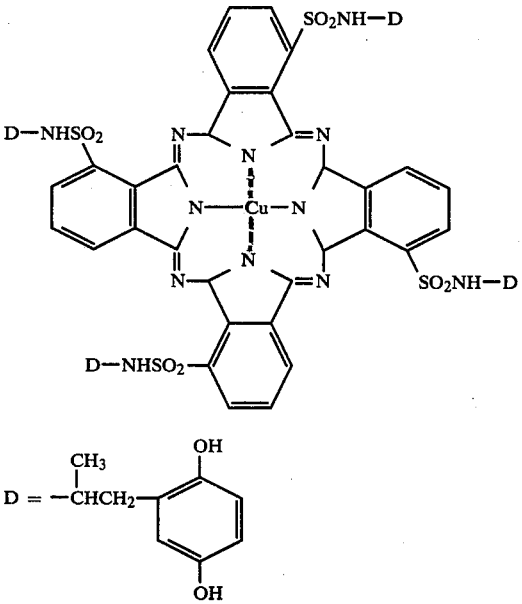

Pattern 34 containing a yellow dye and pattern 44 containing a cyan dye are thus formed in a regularly arranged form wherein the two patterns cross each other at a certain angle. (When the second dye development is conducted after re-halogenating patternwise silver formed by the first dye development, the crossed portions appear green.) The two patterns may cross each other at a right angle or may be arranged in a closely parallel manner or in a mosaic manner without crossing.

In removal of silver grains, a bleaching solution used for ordinary color photographic processing is employed and, as an oxidizing agent, potassium ferricyanide, dichromate, EDTA complex salt, etc., are illustrative. For the purpose of re-halogenation, for example, potassium bromide is added.

On the other hand, the fixing agent for silver halide can be a conventionally well known optional silver halide solvent (for example, sodium thiosulfate, sodium thiocyanate, etc.), and a solution containing such a fixing agent may further contain, if necessary, a preservative (e.g., sodium sulfite), a pH buffer (e.g., boric acid), a pH-adjusting agent (e.g., acetic acid), a chelating agent, etc.

Also, as one of the above-described silver-removing processings, a mono-bath bleach-fixing solution, for example, a mixed solution of potassium ferricyanide and sodium thiosulfate or a mixed solution of iron-EDTA and sodium thiosulfate can be used.

The present invention is now described in more detail by reference to the following examples.

EXAMPLE 1

1,400 ml of a silver bromide emulsion (mean particle size of silver halide: about 0.06μ) was prepared in a conventional manner using 50 g of geletin and 188 g of silver bromide. 0.25 g of 4-methyl-2,3-diethoxythiazolocarbocyanine iodide was added to the emulsion to optically sensitize the emulsion to light of a wavelength of 510 nm to 530 nm. Then, the resulting emulsion was coated on a borosilicate glass disc of a diameter of 1 inch and a thickness of 2.5 mm in a dry thickness of about 3 μm to prepare a photographic light-sensitive material. This photographic light-sensitive materisl was exposed to white light (emitted from a tungsten lamp) through a closely superposed chromium mask for forming a stripe filter having transparent portions of a width of 25 μm with a pitch of 50 μm, immersed for 2 minutes in a 5% formaldehyde aqueous solution to pre-harden, then washed for 3 minutes with water, followed by developing in a developing solution having the following formulation (23° C., 2 minutes).

| Dye-Developing Solution | |
|---|---|
| Dye Developer Y-1 | 2 g |
| Anhydrous Sodium Sulfite | 5 g |
| Sodium Hydroxide | 0.4 g |
| Sodium Sulfate | 30 g |
| Tolylhydroquinone | 3 g |
| Dimethylformamide | 10 ml |
| Water | 1 liter |

After washing with water for 5 minutes, the sample was bleached in a bleaching solution having the following formulation (20° C., 2 minutes).

| Bleaching Solution | |
|---|---|
| Potassium Ferricyanide | 100 g |
| Potassium Bromide | 30 g |
| Water | 1000 ml |

After washing with water for 2 minutes, the sample was processed in a fixing solution of the following formulation (20° C., 2 minutes).

| Fixing Solution | |
|---|---|
| Sodium Thiosulfate | 240 g |
| Sodium Sulfite | 3 g |
| Glacial Acetic Acid | 5 ml |
| Potassium Alum | 6 g |
| Water | 1000 ml |

After washing with water for 10 minutes, the sample was dried. Thus, a yellow stripe filter of a stripe width of 25 μm was obtained.

EXAMPLE 2

The same type of photographic material as described in Example 1 was exposed, pre-hardened and developed in the same manner as described in Example 1, then bleached in the same manner as described in Example 1 whereby a stripe pattern of a mixture of yellow dye and silver halide was obtained. After washing with water for 5 minutes, the sample was dried. Then, the sample was further exposed through a chromium mask having stripes of the same width and the same pitch as in Example 1 while the chromium mask was positioned such that its transparent portions obliquely crossed the above stripes of the mask used in Example 1, and developed in a dye-developing solution of the following formulation.

| Dye-Developing Solution | |
|---|---|
| Dye Developer C-3 | 1.5 g |
| Anhydrous Sodium Sulfite | 5 g |
| Sodium Hydroxide | 0.4 g |
| Sodium Sulfate | 30 g |
| Tolylhydroquinone | 2.5 g |
| Dimethylformamide | 10 ml |
| Water | 1000 ml |

After washing with water for 5 minutes, the photographic material was bleached, washed, fixed, washed, and dried in the same manner as described in Example 1 to obtain a filter wherein yellow and cyan stripes cross each other.

While the invention has been described in detail and with reference to specific embodiments thereof, it will be apparent to one skilled in the art that various changes and modifications can be made therein without departing from the spirit and scope thereof.

What is claimed is:

1. A process for forming a color filter, which comprises (i) patternwise exposing a black-and-white silver halide emulsion layer of a photographic material comprising a support having thereon at least one black-and-white silver halide emulsion layer, (ii) developing the photographic material with a developing solution containing a first color dye developer to form a first pattern containing a first color dye and silver grains, (iii) bleaching away or re-halogenating the silver grains in said first pattern produced in (ii), (iv) again patternwise exposing the photographic material and then developing the photographic material in a developing solution containing a second color dye developer different from said first color dye developer to form another pattern containing a second color dye, and (v) removing remaining silver and/or silver halide after formation of the pattern produced in (iv).

2. The process for forming a color filter as described in claim 1, wherein said process includes repeating said bleaching or re-halogenating and said patternwise exposing and developing with a different color dye developer for each color pattern to be formed.

3. The process for forming a color filter as described in claim 1 or 2, wherein said support is a plate, sheet or film of a synthetic resin, glass, quartz or sapphire.

4. The process for forming a color filter as described in claim 1 or 2, wherein said silver halide emulsion is a fine-grained emulsion.

5. The process for forming a color filter as described in claim 1, wherein said first color dye developer is a yellow dye developer and said second color dye developer is a cyan dye developer or vice versa.

6. The process for forming a color filter as described in claim 2, wherein said first color dye developer is a yellow color dye developer, said second color dye developer is a cyan dye developer and said process includes repeating said bleaching or re-halogenating and said patternwise exposing and developing a third time with a magenta dye developer as a third color dye developer.

* * * * *